US006474524B1

(12) United States Patent
Ivarson et al.

(10) Patent No.: US 6,474,524 B1
(45) Date of Patent: Nov. 5, 2002

(54) BACKPACK APPARATUS

(76) Inventors: Jeffrey J. Ivarson, 2 Bank St., San Anselmo, CA (US) 94960; Henrietta L. Ivarson, 2 Bank St., San Anselmo, CA (US) 94960; Ian C. Ivarson, 2 Bank St., San Anselmo, CA (US) 94960

( * ) Notice: Subject to any disclaimer, the term of this patent is extended or adjusted under 35 U.S.C. 154(b) by 0 days.

(21) Appl. No.: 09/715,700

(22) Filed: Nov. 16, 2000

Related U.S. Application Data

(60) Provisional application No. 60/165,848, filed on Nov. 16, 1999.

(51) Int. Cl.[7] ..... A45F 3/04

(52) U.S. Cl. ..... 224/653; 224/637; 224/638; 224/657

(58) Field of Search ..... 224/581, 637, 224/638, 639, 640, 653, 657, 681

(56) References Cited

U.S. PATENT DOCUMENTS 3,321,120 A * 5/1967 Cunningham ..... 224/235
4,513,866 A * 4/1985 Thomas ..... 190/110
4,941,603 A * 7/1990 Creamer et al. ..... 224/148
5,209,384 A * 5/1993 Anderson ..... 224/223
5,588,529 A * 12/1996 Speck ..... 150/113
5,950,895 A * 9/1999 Zakarin ..... 224/627
5,988,476 A 11/1999 Olerio
6,129,254 A * 10/2000 Yu ..... 190/110
6,161,739 A * 12/2000 Bentzen ..... 224/153

* cited by examiner

*Primary Examiner*—Stephen K. Cronin
(74) *Attorney, Agent, or Firm*—Larry D. Johnson; Craig M. Stainbrook; Johnson & Stainbrook, LLP

(57) ABSTRACT

A pack article includes a flexible container having front, back, right side, and left side panels connected together to define an internal cavity, a flap to enable access to the internal cavity, and at least one divider within the internal cavity connected to and intersecting the back panel at a diagonal, and extending between the right and left side panels to provide a diagonal support surface for an item placed within the pack. The angle of the divider serves to orient the contained load of the pack and direct the weight of the load towards the back panel, thereby distributing the weight along the length of the user's back.

54 Claims, 5 Drawing Sheets

44
38
38
22
20
42
16
12
40
10

10

BACKPACK APPARATUS

This application claims the benefit of U.S. Provisional Application Ser. No. 60/165,848, filed Nov. 16, 1999.

BACKGROUND OF THE INVENTION

1. Field of the Invention

This invention relates generally to packs, backpacks, and luggage, and more specifically to an improved pack apparatus for use as a backpack.

2. Description of the Prior Art

Backpacks, rucksacks, and other "carryable" luggage articles are well-known and in widespread use. Most known backpacks consist of little more than a flexible bag or body defining a box-shaped volume, with a zippered opening and one or more shoulder straps. These backpacks offer minimum organization capability, poor load support, limited access to the contents of the pack, and little carrying comfort during use. For example, with conventional backpacks, the first item that is placed into the pack immediately falls to the bottom of the pack, and is thus the last item able to be taken out, giving the user few options for keeping the contents well organized and protected. The contents of a typical backpack are also prone to shift during movement and use, making access even more difficult. In addition, gravity forces the pack and its contents to sag, shifting the weight down upon the user's lower back, causing discomfort when carrying the backpack.

SUMMARY OF THE INVENTION

The backpack apparatus of this invention provides a pack article including a flexible container having front, back, right side, and left side panels connected together to define an internal cavity, a movable top flap connected to the back panel to enable access to the internal cavity, and at least one divider within the internal cavity connected to and intersecting the back panel at a diagonal, and extending between the right and left side panels to provide a diagonal support surface for an item placed within the pack, when the backpack is in its upright (use) position. The angle of the divider(s) serves to orient the contained load of the pack and direct the weight of the load towards the back panel, thereby distributing the weight along the length of the user's back. The inventive pack also includes one or more shoulder straps, and may include additional zippered compartments, waist straps, chest straps, and other features as warranted.

The inventive backpack thus improves load organization while providing easy access, load stability, and carrying comfort. The interior divider(s) provide built-in organization, support, and quick access for books, files, computers, calculators, diskettes, pens, and other articles and accessories. The diagonal orientation of the divider(s) evenly distributes the weight of the contents to the back panel and shoulder straps for maximum comfort and carrying stability.

DETAILED DESCRIPTION OF A PREFERRED EMBODIMENT

Figure 1:
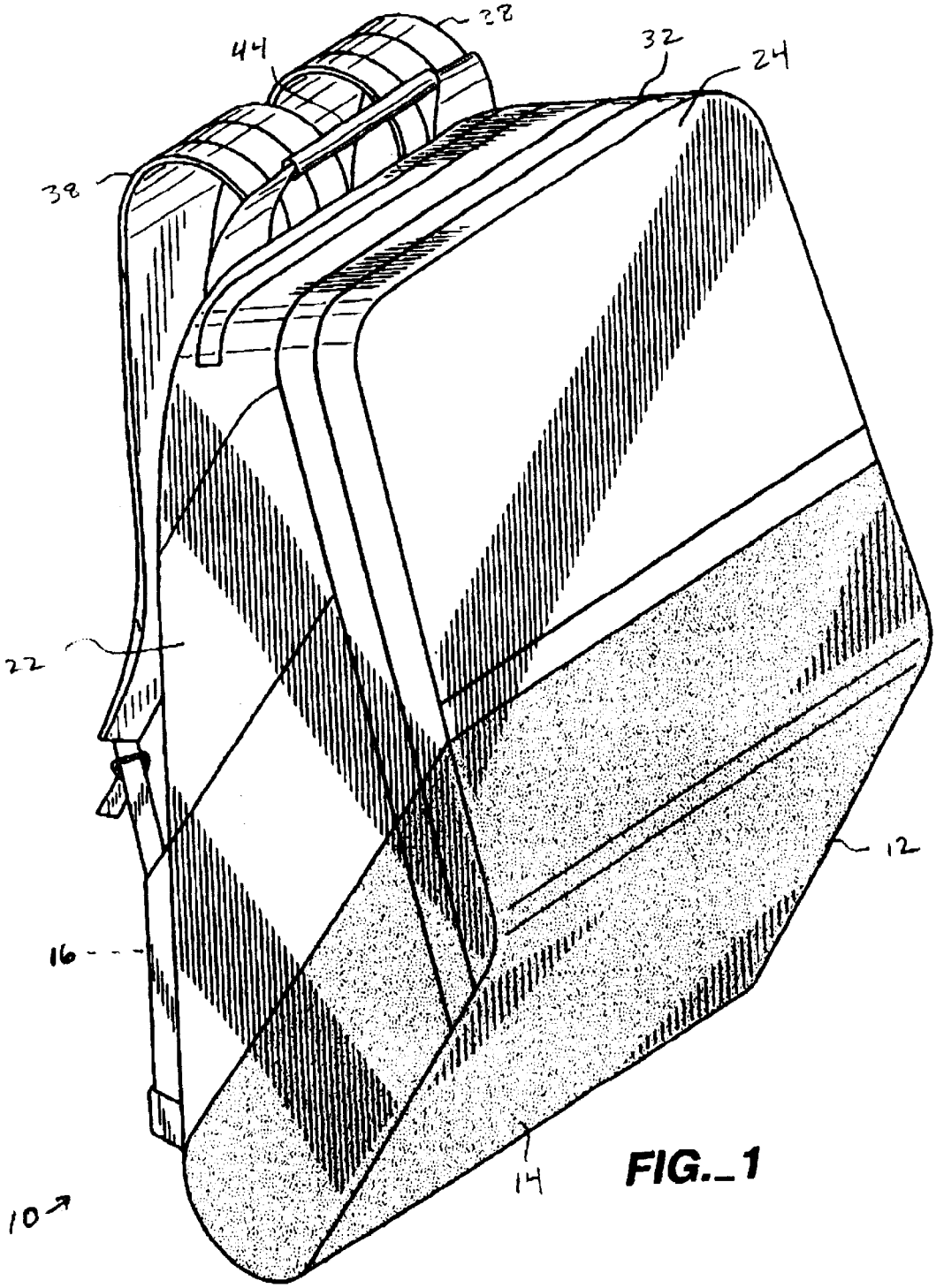
FIG. 1 is a perspective view of the backpack apparatus of this invention.
Figure 2:
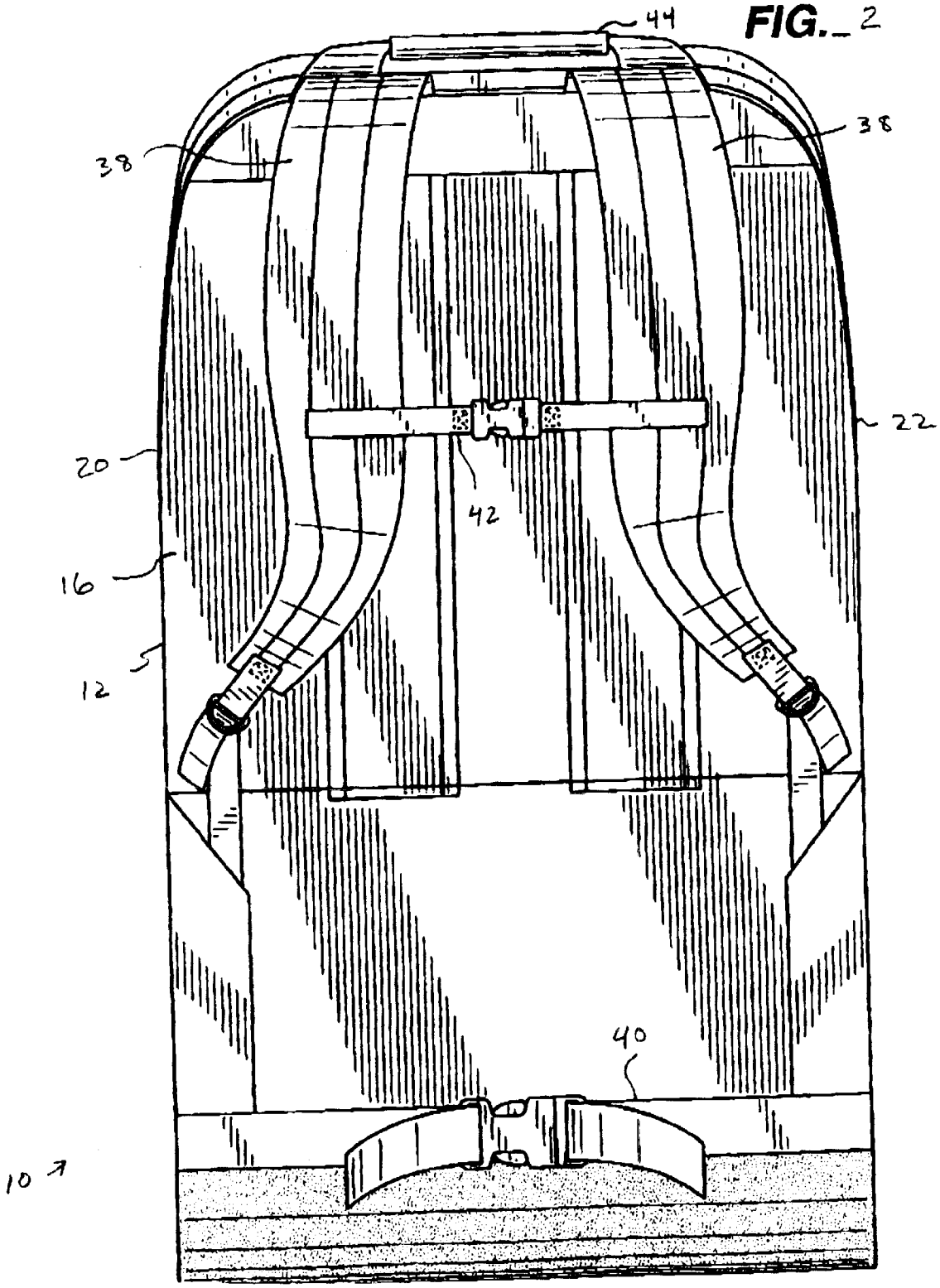
FIG. 2 is a rear elevation view of the backpack.
Figure 3:
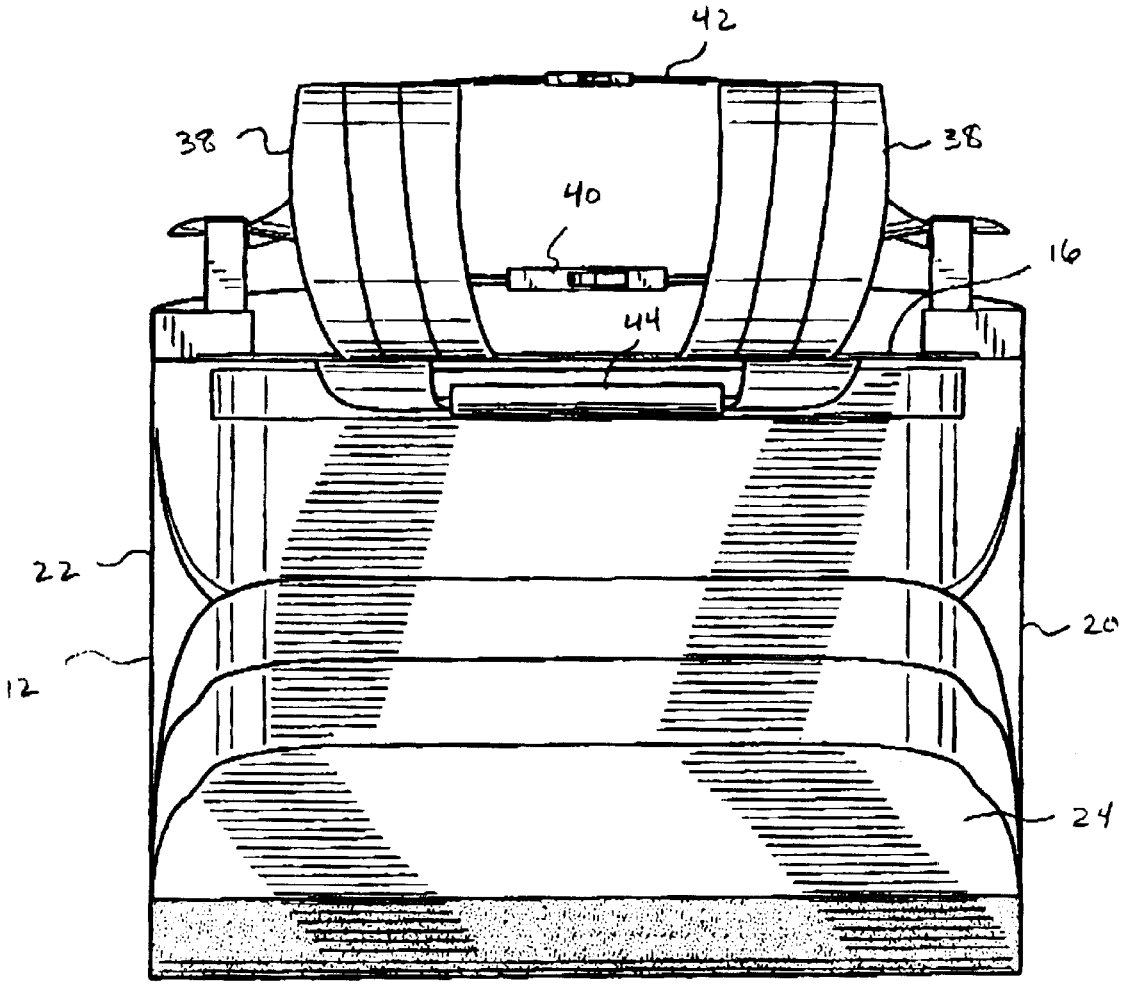
FIG. 3 is a top plan view.
Figure 4:
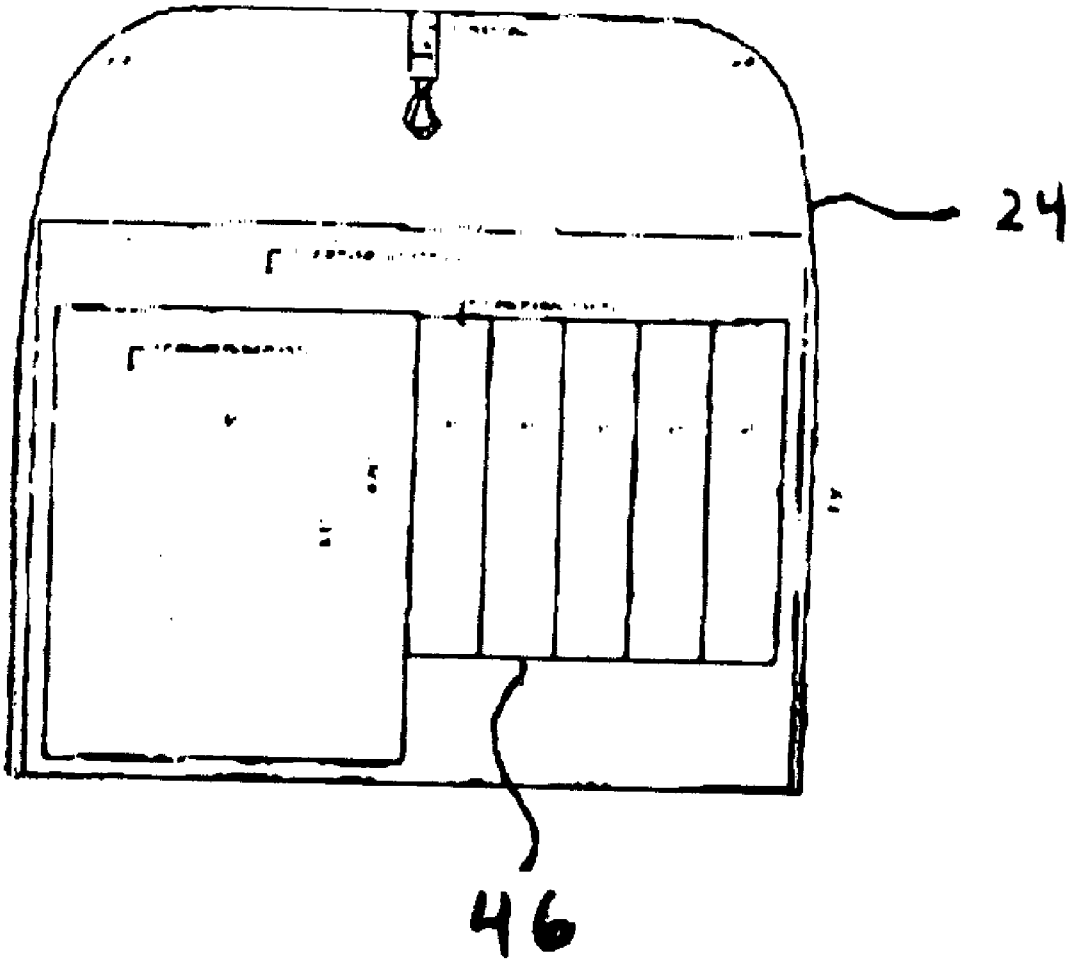
FIG. 4 is front elevation view of the top flap as opened.
Figure 5:
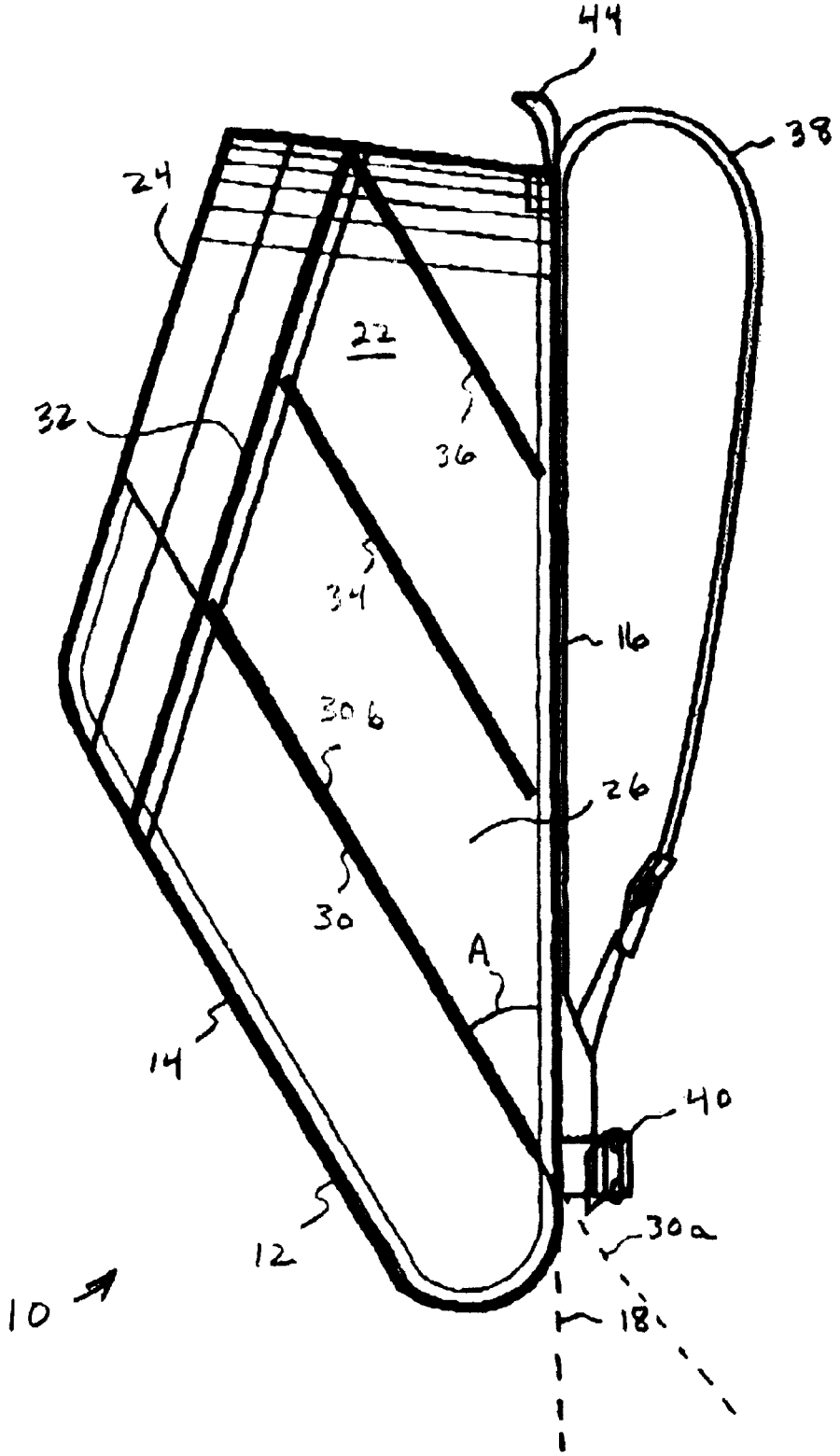
FIG. 5 is a side elevation cross-sectional view of the backpack illustrating the orientation of the interior dividers relative to the back and side panels.

FIG. 1 is a perspective view of the backpack apparatus 10 of this invention, while FIG. 2 is a rear elevation view; FIG. 3 is a top plan view; FIG. 4 is front elevation view of the top flap as opened; and FIG. 5 is a side elevation cross-sectional view. Backpack 10 includes a body member 12 having a front panel 14, a back panel 16 connected to front panel 14 and defining a generally vertical back panel plane 18, a right side panel 20 connecting the front panel 14 and back panel 16 on their right side, a left side panel 22 connecting the front panel 14 and back panel 16 on their left side, and a top panel 24 connected to back panel 16. Together, the front panel 14, back panel 16, right side panel 20, left side panel 22, and top panel 24 defining an interior volume 26. An interior divider member 30 defines a first divider plane 30*a* within interior volume 26, and is connected to back panel 16, right side panel 20, and left side panel 22. First divider plane 30*a* intersects back panel plane 18 at an angle A of between 0 and 90 degrees, and preferably between 30 and 70 degrees (e.g., 60 degrees has been determined to be a suitable angle for many applications), to provide a diagonal support surface 30*b* for an article placed within the interior volume 26. Top panel 24 includes a releasable fastener such as zipper 32 to close upon front panel 14 to enclose the interior volume 26, and open from the front panel 14 to enable access to the interior volume 26 both above and below interior divider member 30.

The preferred embodiment of the backpack apparatus includes a plurality of interior divider members 30, 34, 36, each defining a divider plane generally parallel to the first divider plane 30*a*. In addition, the front panel 14 may be generally parallel to the first divider plane 30*a*, so that the volume between front panel 14 and divider 30 is consistent with the remaining volume in its load orientation, and that front panel 14 itself provides a diagonal support surface.

The interior divider(s) may be removable from the internal volume, or capable of selective positioning within the internal volume, as by affixing the interior dividers to the rear and side panels with a readily releasable fastener such as hook and loop fastener. This would permit user selection of the degree of diagonal support, number of dividers, and the like.

The backpack preferably includes one or more shoulder straps 38, a waist strap 40, a chest strap 42, and a carrying strap 44, all preferably affixed to the back panel 16. Additional storage and organizational features may be provided by pockets 46 on the inside of top panel 24, or elsewhere on the backpack. Further internal and external compartments may be provided anywhere on the body 12 of the backpack, as is well known in the art.

The inventive backpack is preferably constructed of strong, flexible material such as ballistic nylon for abrasion and water resistance. The back and divider panels may be reinforced with polyethylene, foam, or other materials for enhanced rigidity relative to the side panels, rendering the backpack more flexible and collapsible. The back panel in particular may include a cushion material for increased comfort to the user.

While this invention has been described in connection with preferred embodiments thereof, it is obvious that modifications and changes may be made by those skilled in the art to which it pertains without departing from the spirit and scope of this invention. Accordingly, the scope of this invention is to be limited only by the appended claims.

What is claimed as invention is:

1. A backpack apparatus comprising:

A body member having a front panel, a back panel connected to said front panel and defining a generally vertical back panel plane, a right side panel connecting said front panel and back panel on a right side thereof, a left side panel connecting said front panel and back panel on a left side thereof, and a top panel connected to said back panel; said front panel, back panel, right side panel, left side panel, and top panel together defining an interior volume; and At least one interior divider member defining a first divider plane parallel to said front panel within said interior volume and connected to said back panel, right side panel, and left side panel, said first divider plane intersecting said back panel plane at an angle of between 0 and 90 degrees, and providing a diagonal support surface for an article placed within said interior volume, said top panel adapted to close upon said front panel to enclose said interior volume, and open from said front panel to enable access to said interior volume both above and below said interior divider member.

2. The backpack apparatus of claim 1 including a plurality of interior divider members each defining a divider plane parallel to said first divider plane.

3. The backpack apparatus of claim 1 wherein said back panel bears at least one shoulder strap.

4. The backpack apparatus of claim 1 including a carrying handle affixed to said back panel.

5. The backpack apparatus of claim 1 wherein said back panel bears at least one waist strap.

6. The backpack apparatus of claim 1 wherein said back panel bears at least one chest strap.

7. The backpack apparatus of claim 1 wherein said back panel and said at least one interior divider member are reinforced to increase rigidity relative to said side panels.

8. The backpack apparatus of claim 1 wherein said side panels are constructed of a flexible material.

9. The backpack apparatus of claim 1 wherein said top panel is secured to said front panel with a zipper.

10. The backpack apparatus of claim 1 wherein said back panel includes a cushion material.

11. The backpack apparatus of claim 1 wherein said at least one interior divider member is removable.

12. The backpack apparatus of claim 1 wherein said at least one interior divider member is adapted for selective positioning within said interior volume.

13. The backpack apparatus of claim 1 wherein said first divider plane intersects said back panel plane at an angle of between 30 and 70 degrees.

14. A backpack apparatus comprising:

A body member having a front panel, a back panel connected to said front panel and defining a generally vertical back panel plane, a right side panel connecting said front panel and back panel on a right side thereof, a left side panel connecting said front panel and back panel on a left side thereof, and a top panel connected to said back panel; said front panel, back panel, right side panel, left side panel, and top panel together defining an interior volume; and At least one interior divider member defining a first divider plane within said interior volume and removably connected to said back panel, right side panel, and left side panel, said first divider plane intersecting said back panel plane at an angle of between 0 and 90 degrees, and providing a diagonal support surface for an article placed within said interior volume, said top panel adapted to close upon said front panel to enclose said interior volume, and open from said front panel to enable access to said interior volume both above and below said interior divider member.

15. The backpack apparatus of claim 14 including a plurality of interior divider members each defining a divider plane parallel to said first divider plane.

16. The backpack apparatus of claim 14 wherein said front panel is parallel to said first divider plane.

17. The backpack apparatus of claim 14 wherein said back panel bears at least one shoulder strap.

18. The backpack apparatus of claim 14 including a carrying handle affixed to said back panel.

19. The backpack apparatus of claim 14 wherein said back panel bears at least one waist strap.

20. The backpack apparatus of claim 14 wherein said back panel bears at least one chest strap.

21. The backpack apparatus of claim 14 wherein said back panel and said at least one interior divider member are reinforced to increase rigidity relative to said side panels.

22. The backpack apparatus of claim 14 wherein said side panels are constructed of a flexible material.

23. The backpack apparatus of claim 14 wherein said top panel is secured to said front panel with a zipper.

24. The backpack apparatus of claim 14 wherein said back panel includes a cushion material.

25. The backpack apparatus of claim 14 wherein said at least one interior divider member is adapted for selective positioning within said interior volume.

26. The backpack apparatus of claim 14 wherein said first divider plane intersects said back panel plane at an angle of between 30 and 70 degrees.

27. A backpack apparatus comprising:

A body member having a front panel, a back panel connected to said front panel and defining a generally vertical back panel plane, a right side panel connecting said front panel and back panel on a right side thereof, a left side panel connecting said front panel and back panel on a left side thereof, and a top panel connected to said back panel; said front panel, back panel, right side panel, left side panel, and top panel together defining an interior volume; and At least one interior divider member adapted for selective positioning within said interior volume defining a first divider plane within said interior volume and connected to said back panel, right side panel, and left side panel, said first divider plane intersecting said back panel plane at an angle of between 0 and 90 degrees, and providing a diagonal support surface for an article placed within said interior volume, said top panel adapted to close upon said front panel to enclose said interior volume, and open from said front panel to enable access to said interior volume both above and below said interior divider member.

28. The backpack apparatus of claim 27 including a plurality of interior divider members each defining a divider plane parallel to said first divider plane.

29. The backpack apparatus of claim 27 wherein said front panel is parallel to said first divider plane.

30. The backpack apparatus of claim 27 wherein said back panel bears at least one shoulder strap.

31. The backpack apparatus of claim 27 including a carrying handle affixed to said back panel.

32. The backpack apparatus of claim 27 wherein said back panel bears at least one waist strap.

33. The backpack apparatus of claim 27 wherein said back panel bears at least one chest strap.

34. The backpack apparatus of claim 27 wherein said back panel and said at least one interior divider member are reinforced to increase rigidity relative to said side panels.

35. The backpack apparatus of claim 27 wherein said side panels are constructed of a flexible material.

36. The backpack apparatus of claim 27 wherein said top panel is secured to said front panel with a zipper.

37. The backpack apparatus of claim 27 wherein said back panel includes a cushion material.

38. The backpack apparatus of claim 27 wherein said at least one interior divider member is removable.

39. The backpack apparatus of claim 27 wherein said first divider plane intersects said back panel plane at an angle of between 30 and 70 degrees.

40. A backpack apparatus comprising:

A flexible container having front, back, right side, and left side panel portions connected together to define an internal cavity;

a movable top flap portion connected to said back panel and enabling access to said internal cavity;

a divider member within said internal cavity connected to and intersecting said back panel at a diagonal, and extending between said right side panel and left side panel, and providing a diagonal support surface for an article placed within said internal cavity; and Said front panel portion is parallel to said divider member and provides a further diagonal support surface.

41. The backpack apparatus of claim 40 including a plurality of divider members each intersecting said back panel at a diagonal.

42. The backpack apparatus of claim 40 wherein said back panel portion bears a pair of shoulder straps.

43. The backpack apparatus of claim 40 including a carrying handle affixed to said back panel portion.

44. The backpack apparatus of claim 40 wherein said back panel portion bears at least one waist strap.

45. A backpack apparatus comprising:

A flexible container having front, back, right side, and left side panel portions connected together to define an internal cavity;

a movable top flap portion connected to said back panel and enabling access to said internal cavity;

a plurality of parallel divider members within said internal cavity, each of said divider members accessible from said movable top flap portion, each of said divider members connected to and intersecting said back panel at a diagonal, and extending between said right side panel and left side panel, and each of said divider members providing a diagonal support surface for articles placed within said internal cavity.

46. The backpack apparatus of claim 45 wherein said back panel bears at least one shoulder strap.

47. The backpack apparatus of claim 45 including a carrying handle affixed to said back panel.

48. The backpack apparatus of claim 45 wherein said back panel bears at least one waist strap.

49. The backpack apparatus of claim 45 wherein said back panel bears at least one chest strap.

50. The backpack apparatus of claim 45 wherein said back panel and said at least one interior divider member are reinforced to increase rigidity relative to said side panels.

51. The backpack apparatus of claim 45 wherein said side panels are constructed of a flexible material.

52. The backpack apparatus of claim 45 wherein said top panel is secured to said front panel with a zipper.

53. The backpack apparatus of claim 45 wherein said back panel includes a cushion material.

54. The backpack apparatus of claim 45 wherein said first divider plane intersects said back panel plane at an angle of between 30 and 70 degrees.

* * * * *